United States Patent [19]

Schmidt

[11] Patent Number: 4,521,022

[45] Date of Patent: Jun. 4, 1985

[54] GOLF IRON FACE

[76] Inventor: Glenn H. Schmidt, 1857 Los Encinos, Glendale, Calif. 91208

[21] Appl. No.: 495,520

[22] Filed: May 17, 1983

[51] Int. Cl.[3] ..... A63B 53/04

[52] U.S. Cl. ..... 273/175; 273/77 A

[58] Field of Search ..... 273/175, 167 J, 167 B, 273/167 C, 167 D, 167 F, 77 A

[56] References Cited

U.S. PATENT DOCUMENTS 2,023,885 12/1935 Hinckley ..... 273/175 X 2,395,837 3/1946 Baymiller et al. ..... 273/175

OTHER PUBLICATIONS

"Golf Digest", Jul. 1965, pp. 70, 71, 72, 74 & 75.

*Primary Examiner*—George J. Marlo

*Attorney, Agent, or Firm*—William W. Haefliger

[57] ABSTRACT

A golf iron has a front face with substantially hyperbolic forward convexity.

7 Claims, 7 Drawing Figures

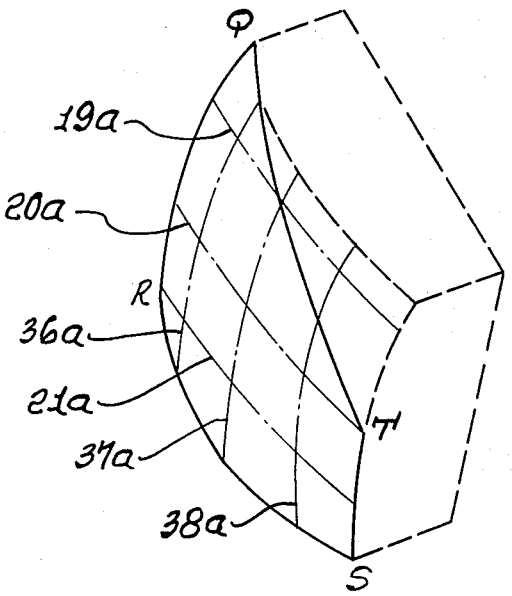
FIG. 5.
FIG. 6.
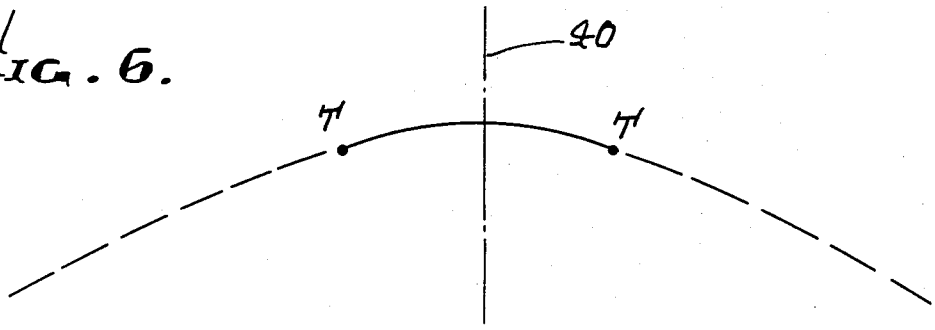
FIG. 7.
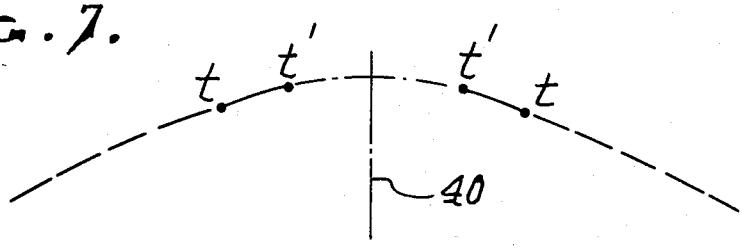

GOLF IRON FACE

BACKGROUND OF THE INVENTION

This invention relates generally to golf clubs, and more particularly to an "iron" head.

A common problem in golf is the slice produced as a result of striking the ball off-center relative to the centered sweet spot at the front face of an iron head. While front faces have been made with different inclinations, the unwanted "slice", and also "hook" remain as problems.

SUMMARY OF THE INVENTION

It is a major object of the invention is to provide an improved iron head that combines the objectives of increasing the self-correcting spin of the ball with the desired visual effect of a trapezoidal head front face. Basically, the head is characterized by the front face having bulge curvature defined by intersections with that face of planes generally normal to that face, such intersections defining curved lines which are substantially hyperbolic, with formed convexity. This is typically employed in a trapezoidal front face zone.

As a result, the ball struck off-center by that hyperbolic face is given a spin-rotation that tends to more effectively pull the ball's line of flight back toward the desired straight path, than for a circularly curved front face.

As will appear, the crests of such hyperbolic lines of intersection may be blunted to have less curvature than the crest of the hyperbola; and the front face may have roll curvature defined by hyperbolic lines of intersections; or, the front face may be defined by an hyperboloid of revolution.

These and other objects and advantages of the invention, as well as the details of an illustrative embodiment, will be more fully understood from the following specification and drawings, in which:

DRAWING DESCRIPTION

FIG. 5 is an enlarged perspective view showing bulge curvature development;

FIG. 6 is a section showing front face curvature; and

FIG. 7 is another section showing front face curvature.

DETAILED DESCRIPTION

Figure 1:
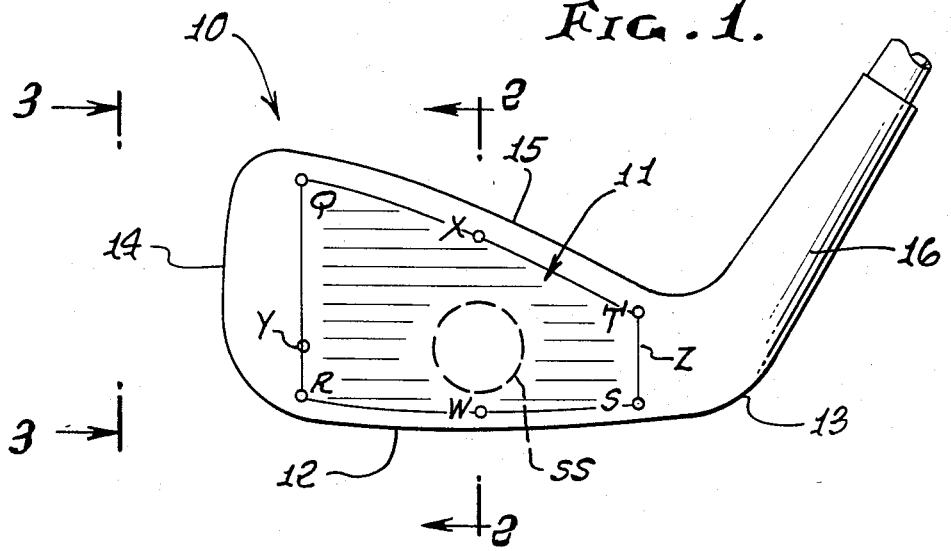
FIG. 1 is an elevational view of a golf iron front face incorporating the invention.

In FIGS. 1–4, the golf club head 10 comprises a metallic "iron", such as irons normally designated 1, 3, 5, 7, 9, for example. They are characterized as having centers of gravity relatively close to the iron front face 11, as distinguished from "woods", whose centers of gravity are much further, i.e. rearwardly, of the front face. See for example the approximate center of gravity location labeled CG in FIG. 2. The front face 11 is the face adapted to strike the golf ball, and normally has upward and rearward inclination from vertical, as for example is shown by loft angle $\alpha$ in FIG. 2. That angle increases as the designation number of the iron increases. The head also has a lower surface 12, heel 13, toe 14, and top surface 15 normally inclined downwardly toward the heel, from the top of the toe, as clearly appears in FIG. 1. A hosel appears at 16, and the head rear face is shown at 17.

Considering that the front face is a hyperbolic wall traveling in the forward direction, should the ball be struck off-center i.e. at the toe side of center, the ball is given an intensified spin rotation as the ball is driven forwardly. While the ball is driven in a direction angled from the forward direction, the ball clockwise spin rotation tends to correct for such deviation and to pull the ball back toward the forward direction due to the interaction of the spinning ball with the air through which it travels. As a result, the fact that the ball is struck "off-center" is of less concern toward the production of an unwanted "slice", due to the fact that the use of hyperbolic face tends to produce a compensating effect, as described. If the ball is struck off-center at the heel side of center, a similar rotation of the ball in counter-clockwise mode is produced, to produce compensation tending to pull the ball direction of travel back toward the forward direction. Therefore, the result of misaligning the iron head with the ball is of less undesirable consequence than with flat iron faces, due to the intensified spin imparted to the ball by the club head of the present invention.

Figure 2:
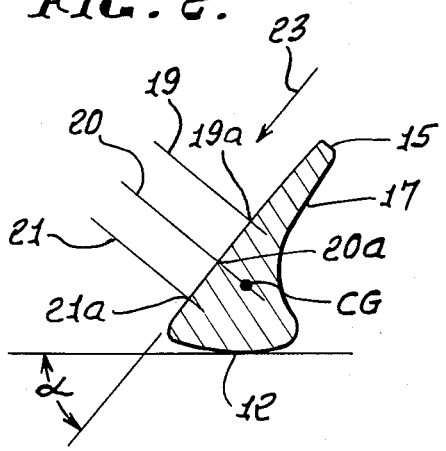
FIG. 2 is a vertical section on lines 2—2 of FIG. 1.
Figure 3:
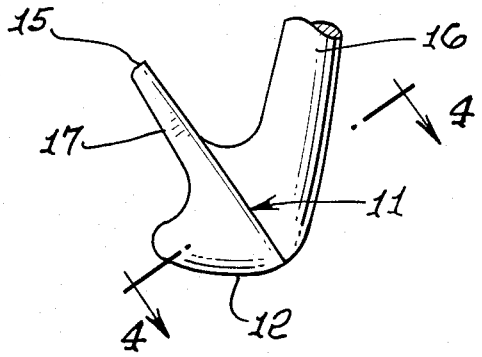
FIG. 3 is an end view on lines 3—3 of FIG. 1.

The front face 11 is approximately trapezoidal, as shown in FIG. 1 within perimeter lines Q-R, R-W-S, S-T and T-X-Q. Face 11 has bulge curvature defined by the intersections, with face 11, of parallel planes 19-21 tilted from horizontal and normal to face 11, as seen in FIG. 2. Further, such intersections define curved lines 19*a*–21*a* (see line 20*a* in FIG. 4, for example) which are hyperbolic. One such hyperbolic line is seen in FIG. 6 and designated T-T. It is viewed in the direction of arrow 23 in FIG. 2. Crest portion or arc t-t of that line may, for example, extend from Y to Z in FIG. 4. FIG. 7 shows a modified crest portion, which is flattened to have less curvature in the central region t'-t' of the arc t-t, (i.e. the sweet spot, requiring less compensation).

Figure 4:
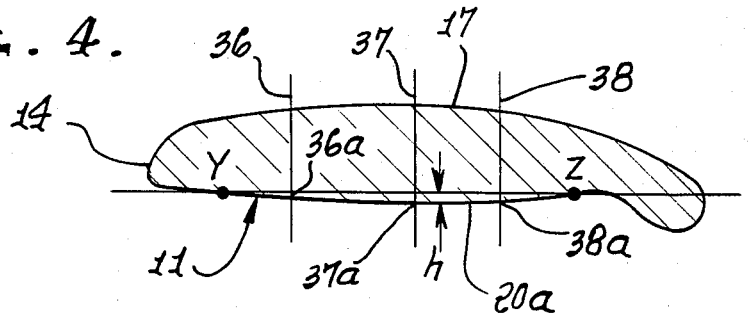
FIG. 4 is a section on lines 4—4 of FIG. 3.

The front face 11 may have also have roll curvature defined by intersections with that face of forwardly extending vertical planes, as exemplified by planes 36–38 in FIG. 4. Such linear intersections lines 36*a*–38*a* are forwardly convex, and are typically hyperbolic. FIG. 5 also shows such intersection lines 36*a*–38*a* as well as the horizontal intersection lines 19*a*–21*a*. Such construction causes the ball to compensate for being struck above or below the sweet spot (indicated by circle SS in FIG. 1), so as to lessen the chances of the ball failing to get off the ground, or rising too high in its flight path.

The front face may alternatively have the surface shape of an hyperboloid of revolution, formed for example by rotation of the curve t-t of FIG. 6 about axis 40 which symmetrically bisects the hyperbola T-T, or t-t. A similar surface formed by rotation of lines t-t in FIG. 7 about axis 40 forms a front face 11 surface that is an hyperbola of revolution with its crest made to have shallower curvature, i.e. blunted.

in the above, the maximum forward protrusions of the generally horizontal lines of hyperbolic intersections 19*a*–21*a* from the flat plane containing points Q, R, S and T lines are less than $\frac{1}{8}$ inch. See protrusion "h" in FIG. 4, for example. The bulging trapezoid of face 11 shown defines a ball impact area covering the bulk of the front face area.

I claim:

1. In a golf iron head having a heel, toe, bottom surface, a rear side and a front face to strike a ball, said front face angled from vertical in ball addressing position, the improvement comprising (a) said front face having bulge curvature defined by the intersections with said face of planes generally normal to said front face, extending in heel to toe directions, (b) said intersections defining curved lines which are substantially hyperbolic with forward convexity, (c) said curved lines protruding forwardly, relative to a plane passing through vertically spaced points on the front face near the toe, and through vertically spaced points on the front face near the heel, said hyperbolic curved lines of intersection located within a trapezoidal area defined by said front face, the corners of said trapezoidal area defined by said points, the maximum forward protusion of said hyperbolic curved lines relative to said plane being less than $\frac{1}{8}$ inch.

2. The improvement of claim 1 wherein said hyperbolic lines defined in sub-paragraph (b) are symmetric with respect to a plane extending rearward of the center of said front face.

3. The improvement of claim 1 wherein said front face also has roll curvature defined by intersections of forwardly extending vertical planes with said front face, said last named intersections defining curved lines which are forwardly convex.

4. The improvement of claim 3 wherein said last named curved lines are substantially hyperbolic.

5. The improvement of claim 1 wherein said iron is selected from the group that includes irons with front face angularity from vertical and with numbers between and including 1 and 9.

6. The improvement of claim 1 wherein said front face has the curvature of an hyperboloid of revolution about an axis that extends rearwardly.

7. The improvement of claim 1 wherein the front face has a sweet spot located within and generally at the middle of said trapezoidal area, said curved lines of intersections, at the sweet spot, being flattened to have less curvature than the curvatures of said hyperbolic lines outside the sweet spot.

* * * * *